United States Patent [19]

Brandin

[11] 4,315,410

[45] Feb. 16, 1982

[54] METHOD AND APPARATUS FOR MAKING ICE BLOCKS

[75] Inventor: Ivar Brandin, Norrkoping, Sweden

[73] Assignee: Stal Refrigeration AB, Norrkoping, Sweden

[21] Appl. No.: 149,131

[22] Filed: May 12, 1980

[51] Int. Cl.[3] ..... F25C 1/00

[52] U.S. Cl. ..... 62/66; 62/260; 405/130

[58] Field of Search ..... 299/11; 405/130; 62/235, 260, 66, 340

[56] References Cited

U.S. PATENT DOCUMENTS

| | | | |
|---|---|---|---|
| 1,207,569 | 12/1916 | Langerfeld | 299/11 |
| 3,287,915 | 11/1966 | Massey | 62/260 X |
| 3,333,421 | 8/1967 | Shock et al. | 62/260 X |
| 3,344,607 | 10/1967 | Vignovich | 62/260 X |
| 3,893,507 | 7/1975 | MacCracken et al. | 62/235 X |
| 3,910,059 | 10/1975 | MacCracken | 405/130 X |
| 3,986,342 | 10/1976 | MacCracken | 62/235 X |

*Primary Examiner*—William E. Tapolcai, Jr.
*Attorney, Agent, or Firm*—Cyrus S. Hapgood

[57] ABSTRACT

Flexible pipes unwound from a supply drum are placed adjacent a wall to be supported, and water is applied to the outside of the pipes while passing through them a cooling medium at a temperature below the melting point of ice, thereby freezing a first ice layer against the wall. Cooling medium at a temperature above the ice melting point is then passed through the pipes to loosen them from the ice; and at least some of the pipes are rewound on the drum to remove them from the first ice layer and are then replaced outside but adjacent thereto, after which the procedure is repeated until enough ice layers are formed to provide a block of desired thickness.

6 Claims, 1 Drawing Figure

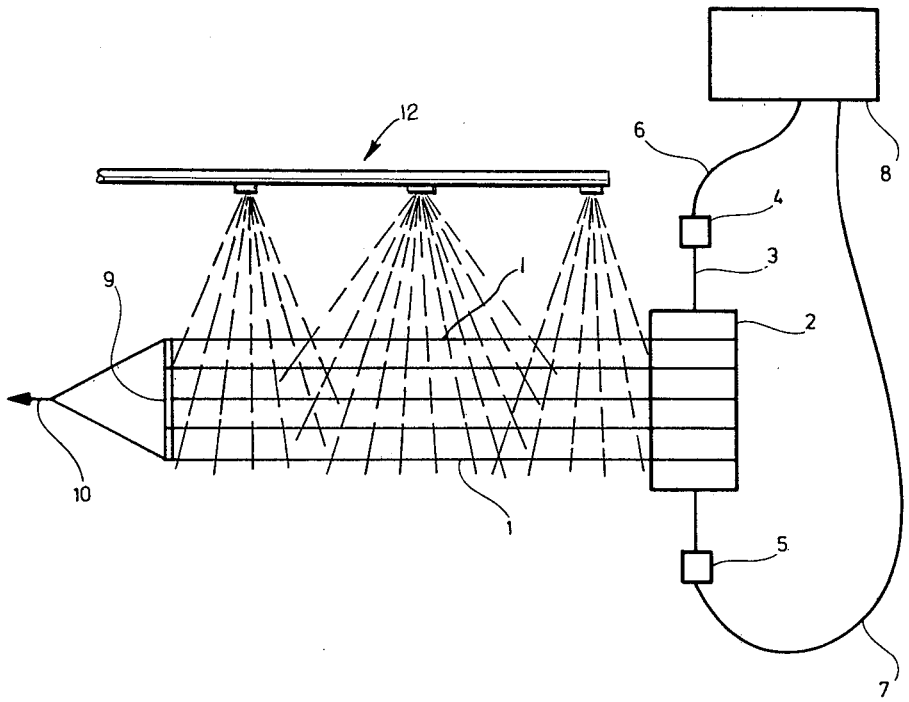
12
6
8
4
3
9
1
2
10
1
5
7

METHOD AND APPARATUS FOR MAKING ICE BLOCKS

This invention relates to a method and apparatus for production of ice blocks used as a supporting structure against the walls of mining drift, concrete containers, etc., a number of pipes being utilized as cooling elements, in which pipes a cooling medium is caused to flow.

It has long been known to use ice as a supporting structure in ore-mining and coal-mining, as disclosed for example in U.S. Pat. No. 1,207,569. This patent discloses the filling of mining drifts, etc., in order to prevent them from caving in. The utilization of ice as a supporting structure does not seem to have spread to any appreciable extent. One reason for this fact is probably that no efficient methods for production of the ice structures have been known. It has been suggested, for instance, that the ice be produced where it is to be used and in such a way that water is gradually sprayed into a chamber, the walls of which are extensively cooled. Alternatively, it has been suggested that ice be produced by passing chilled air through a spray of water droplets, which are thus transformed to snow, which is gradually packed to ice.

None of the prior methods can be expected to yield an ice structure with good strength in an economically feasible way. As ice for supporting structures has attracted an increasing interest in different fields, such as mining, large pontoons, etc., an object of this invention is to provide a method and apparatus of the type first mentioned by which ice of good strength can be produced efficiently and economically.

According to the invention, the cooling medium is given a temperature below the melting point of the ice, and the pipes are caused to freeze a first water layer, whereupon the cooling medium is given a temperature above the melting point of the ice, and then at least some of the pipes are removed from the ice layer thus formed.

The pipes removed from the ice layer can be put outside of the ice layer, whereupon the cooling medium once more is given a temperature below the melting point of the ice and a second water layer is frozen, the procedure then being repeated with further water layers until an ice block of the desired thickness is obtained.

It is also possible, of course, to arrange the pipes removably in a plurality of layers above each other, and then add water which gradually rises to cover the uppermost pipes. There may be provided, for instance, a simple bracket system on which the pipes are placed loosely, in order that they may be removed from said bracket system, which will thus remain frozen in the ice block.

It is suitable to use flexible pipes as cooling elements, especially pipes which include within themselves at least one flow way in the forward direction and one flow way in the return direction for the cooling medium.

Considering the capacity of the ice block to adhere to the walls which it is intended to support, and the maintenance of this adhesive capacity, it is advantageous to leave at least some pipes located in the vicinity of said wall after the freezing, cooling medium with a temperature below the melting point of the ice being caused to flow in said pipes. It would of course be possible to maintain good adhesive capacity and strength in other ways, as by circulating cold air or by pre-cooling of the walls which are to be supported, but the way previously mentioned will probably be preferred in most cases, especially if the adhesive capacity and the strength are to be maintained during long periods of time.

A suitable apparatus for carrying out the method includes a number of flexible pipes provided with an inner parting wall, permitting a flow in the forward direction during a return flow in the same pipe, and a drum pivotally mounted so that the pipes can be wound onto the drum, the pipes being united at their ends directed towards the drum by a manifold which is connected to a source of cooling medium.

One embodiment of the invention is described more in detail below, reference being made to the accompanying drawing in which the single illustration is a schematic view of an apparatus for carrying out the method according to the invention.

A number of flexible pipes 1 are provided either with an inner longitudinal parting wall, dividing the pipes into two halves, or a parting wall in the form of an inner pipe, so that each pipe consists of a double mantle. The pipes are fixed to a manifold (not shown) on a drum 2 provided with a longitudinal axis 3 around which the drum is pivoted. At its end remote from the drum, each pipe is provided with an opening in the parting wall which makes a flow in both directions in the same pipe possible. The manifold is connected to axis 3 which is divided into two hollow sections separated from each other and connected to respective swivels 4 and 5. The latter in turn are connected to a cooling medium source 8 via lines 6 and 7, respectively. The manifold is designed in such a way that the cooling medium can be circulated from the source 8 via line 6, swivel 4, axis 3 and further in the forward and return direction through pipes 1, returning through axis 3, swivel 5 and line 7 to cooling medium source 8. This arrangement is not shown in full detail, as its details will be readily understood by those skilled in the art. The arrangement serves to deliver cooling medium at a temperature lower as well as higher than the melting point of the ice. Pipes 1, at their ends remote from the drum 2, are removably attached to a strut 9 provided with a hook coupling 10.

In the operation of the apparatus, pipes 1 are pulled from drum 2 by a winch or the like, coupled to the hook coupling 10, and are placed on the base on which the ice block is to be formed. This base can of course be oriented in different ways but is usually more or less horizontal. Cooling medium having a lower temperature than the melting point of the ice is circulated through pipes 1, and water is added to the outside of the pipes until an ice layer has been formed. Cooling medium at a higher temperature than the melting point of the ice is then circulated during a relatively short period of time, so that the pipes become loosened from the ice and can be rewound on the drum 2. Thereupon, the temperature of the circulating cooling medium is lowered, the pipes are again unwound from drum 2 and placed upon the ice layer previously formed, and a new ice layer is frozen. In some instances, in order to maintain good adhesion of the ice against the walls to be supported and to maintain the strength of the ice, it is desirable to leave a few pipes in the ice, especially in the vicinity of said walls, so that cooling medium can be circulated through these retained pipes for maintaining freezing.

In the case where the pipes are removably arranged in a plurality of layers above each other, I have referred to the addition of water "which gradually rises to cover the uppermost pipes". This would obviously require the use of at least temporary walls for retaining the added water around the pipes to permit such gradual rising. Of course, a simpler way to apply the water to the exterior of the pipes is by spraying it directly on the pipes, whereby the retaining walls can be omitted. As will be readily understood by those skilled in the art, such spraying causes a gradual build-up of ice on the pipes, and the part of the spray which remains unfrozen can be collected and returned to the spraying device. As an example of a suitable spraying device, a water supply duct 12 is located above the level of pipes 1 and is provided with nozzles from which the spray is directed upon the pipes.

As previously mentioned, the arrangement 3–8 serves to deliver cooling medium at a temperature lower as well as higher than the melting point of the ice. It will be readily understood by those skilled in the art that the shift from one temperature to the other may be effected by connecting the cooling medium source 8 alternately to separate supplies (not shown) of a cooling medium at the lower temperature and a cooling medium at the higher temperature.

I claim:

1. In the production of ice blocks for use as a supporting structure against a wall, the method which comprises placing a plurality of pipes in the immediate vicinity of said wall, applying water to said pipes externally thereof while passing through the pipes a cooling medium having a temperature below the melting point of ice, thereby freezing a layer of ice on said wall, then passing through said pipes a cooling medium having a temperature above the melting point of the ice, thereby loosening the pipes from the ice, and removing at least some of the pipes from said ice layer.

2. The method of claim 1, which comprises also the steps of placing said removed pipes outside the ice layer in the immediate vicinity thereof, then again applying water to said last pipes externally thereof while passing through them a cooling medium having a temperature below the melting point of the ice, thereby freezing a second layer of ice on the firstmentioned layer, then passing through said last pipes a cooling medium having a temperature above the melting point of the ice, to loosen the pipes from said second layer, and removing at least some of the pipes from said second layer.

3. The method of claim 2, which comprises also repeating said steps until an ice block of desired thickness is obtained.

4. The method of claim 1, in which said pipes are flexible, the method comprising also the steps of winding the flexible pipes on a supply drum, pulling the pipes from said drum to place them in the immediate vicinity of said wall, and rewinding at least some of the pipes on the drum to remove them from said ice layer.

5. The method of claim 1, in which said cooling medium is passed simultaneously in opposite directions through each pipe.

6. The method of claim 1, in which at least some pipes, located in the ice in the vicinity of said wall, are retained in the ice after the other pipes are removed therefrom, the method comprising also passing through said retained pipes a cooling medium having a temperature lower than the melting point of the ice.

* * * * *